US008499467B2

(12) United States Patent
Elardo

(10) Patent No.: US 8,499,467 B2
(45) Date of Patent: Aug. 6, 2013

(54) CLAY CUTTING AND BEVELING TOOL

(76) Inventor: Larry W Elardo, Groveland, MA (US)

( * ) Notice: Subject to any disclaimer, the term of this patent is extended or adjusted under 35 U.S.C. 154(b) by 311 days.

(21) Appl. No.: 13/080,645

(22) Filed: Apr. 5, 2011

(65) Prior Publication Data

US 2011/0247221 A1 Oct. 13, 2011

Related U.S. Application Data

(60) Provisional application No. 61/341,900, filed on Apr. 7, 2010.

(51) Int. Cl.
*B43L 7/00* (2006.01)

(52) U.S. Cl.
USPC ..... 33/485; 33/32.3

(58) Field of Classification Search
USPC ..... 33/32.1, 32.2, 32.3, 41.1, 42, 484, 33/485
See application file for complete search history.

(56) References Cited

U.S. PATENT DOCUMENTS

| | | | | | |
|---|---|---|---|---|---|
| 1,396,806 | A * | 11/1921 | Beals | 33/485 |
| 2,238,558 | A | 4/1940 | Edgren | |
| 3,068,580 | A * | 12/1962 | Orthwin | 33/485 |
| 3,964,360 | A | 6/1976 | Schwartz | |
| 4,158,977 | A | 6/1979 | Logan | |
| 4,662,258 | A | 5/1987 | Mood | |
| 4,670,990 | A * | 6/1987 | Horvath | 33/485 |
| 5,271,305 | A * | 12/1993 | Peters et al. | 33/32.1 |
| 5,309,642 | A * | 5/1994 | McGinnis | 33/32.2 |
| 6,829,833 | B2 * | 12/2004 | Langman | 33/32.2 |
| 6,851,201 | B1 * | 2/2005 | Gioia et al. | 33/42 |
| 2002/0095804 | A1 * | 7/2002 | Coplan | 33/484 |

* cited by examiner

*Primary Examiner* — G. Bradley Bennett
(74) *Attorney, Agent, or Firm* — Invention Management Assoc.; Edward L. Kelley

(57) ABSTRACT

A clay cutting and beveling tool (100, 300) includes a guide ruler (115) including a guiding edge (410) and a cutting guide (120) in sliding engagement with the guiding edge. The cutting guide includes a body (520) formed with a plurality of angled through holes (530) each passing through the body at a different angle. The tool (100) is placed onto a clay slab (105) with a support surface (445) in contact with a top surface of the clay slab. A pin tool (110) is inserted into one of the angled through holes and left in engagement with the angled through hole as the cutting guide is advanced along the guiding edge. The pin tool cuts the clay slab with a beveled cut. A non-beveled through hole (535) also passes through the body (520) and is used to make non-beveled cuts.

20 Claims, 7 Drawing Sheets

CLAY CUTTING AND BEVELING TOOL

CROSS REFERENCE TO PRIOR APPLICATIONS

This application claims priority under 35 U.S.C. 119(e) based upon Provisional Application Ser. No. 61/341,900 entitled Accu Angle, filed Apr. 7, 2010 which is incorporated herein by reference in its entirety.

BACKGROUND OF THE INVENTION

1. Field of the Invention

The present invention relates to clay forming. More specifically the invention is a clay cutting tool configured to cut clay elements, e.g. strips and other shapes from a soft clay slab.

2. Description of the Related Art

Clay elements cut from a clay slab or the like are assembled to form various clay objects. The assembled clay objects may comprise cylindrical and rectilinear enclosures e.g. clay pots, boxes, cups, pitchers, etc. or various other clay objects such as plates, bowls etc. which all may be assembled from a plurality of clay elements cut from a clay slab and joined together at seams or joints.

The use of beveled edges to join clay elements is known and desirable. Beveled edges increase joint or seam surface area and this provides a stronger joint. When two clay elements are joined at a 90 degree corner using a perpendicular joint, (no bevel) the joint contact dimension is equal to the thickness of the clay slab. However, when the same two clay elements are joined at a 90 degree corner using a 45 degree bevel the joint contact dimension is equal to 1.414 times the thickness of the clay slab. The increased joint contact dimension provides a stronger joint.

Conventional clay forming methods use a first step to cut a clay element from a clay slab and a second step to bevel edges that will be joined to other clay elements. More specifically a clay element cut from the clay slab is cut with perpendicular edges such that a cross-section of the clay element has four 90 degree corners. Thereafter a beveling tool is used to bevel edges that will be used to join the clay element to other clay elements. A conventional beveling tool comprises a body, e.g. a wood block that supports a tensioned wire or the like at a desired beveling angle. The conventional beveling tool is advanced along a clay element parallel to a perpendicular edge thereof. During the advancing step, the tensioned wire intersects the perpendicular edge at a desired beveling angle and cuts clay from the perpendicular edge to form a beveled edge. While the beveling tool can be advanced parallel to a perpendicular edge of the clay element without a guide, a straight edge is usually used to guide movement of the beveling tool. Typically the straight edge is positioned parallel to the perpendicular edge being beveled at a setback distance, e.g. equal to the thickness of the clay element, and the beveling tool is held against the straight edge as it is advance along the perpendicular edge of the clay element.

One problem with conventional clay beveling tools is that each beveling tool is configured for only one beveling angle. Thus a user needs to buy a different beveling tool for each desired beveling angle. Another problem with conventional beveling tools is that commercially available clay beveling tools are limited to only three beveling angles 30, 45 and 60 degrees and this has forced some users to custom make clay beveling tools for beveling angles other than 30, 45 and 60 degrees.

Another problem with conventional clay beveling tools is the need to align a straight guide edge parallel to and setback from a perpendicular edge being beveled. The problem with this is that when the alignment of the straight guide edge is not perfect, the resulting beveled edge is imperfect and may not match with a beveled mating part and the mismatch may require reshaping of the joint or seam at an assembly step.

A further problem with conventional clay beveling tools is that they can only remove clay from an upward facing surface. More specifically conventional clay beveling tools cut bevel angle of 30, 45 and 60 degrees as measured from the upward facing surface of the clay slab. However, due to the nature of the joining process; this typically requires that an unfinished surface of the clay element face upward during the beveling step. Thus in most applications, a user is forced to turn the clay element over placing its finished surface face down on a support surface with its unfinished surface face up in order to bevel its edges as required for assembly. However by turning the clay element over for beveling may deform its overall shape and the shape of any decorative featured formed on the finished side. The deformations may lead to poor fit or may render the clay element unusable.

A further problem with conventional clay beveling tools is that they are difficult to use on narrow clay elements. For example, if a user wished to bevel the edges of a 1 inch wide clay element it would be difficult to support and hold a straight guide edge on an upward facing surface of the 1 inch wide clay element and additional steps may be required to support and hold the straight guide edge in place during the beveling step.

After beveling, beveled clay elements are assembly into a clay object and this is usually done while the clay elements are still moist. In cases where a beveled edge is not well formed, e.g. when they have been formed by a conventional beveling tool, a user may reshape the clay by hand or using tools to adjust the fit and shape of joints or seams. However as the clay dries any clay that was reshaped attempts to return to its original shape (known as clay memory) and this tends to distort the reshaped joints and seams. Similarly when an assembled clay object is fired in a kiln, the firing process may heat the clay object to a near molten temperature and the heating process may also cause the clay to move. The movement typically affects the integrity of poorly formed seams and joints which can be distorted into non-straight or meandering edges.

SUMMARY OF THE INVENTION

The present invention overcomes the problems cited in the prior art by providing a cutting and beveling tool (100) that cuts and bevels in a single cutting step. Moreover the cutting and beveling tool cuts and bevels from the finished or upward facing surface of a clay element or slab and beveling angles formed by the cutting and beveling tool are greater than 90 degrees as measured from the upward facing or finished surface.

More specifically the cutting and beveling tool (100, 300) includes a guide ruler (115, 305, 400, 405) and a cutting guide (120, 310, 500, 510) movably engaged with the guide ruler. The guide ruler includes a first support surface (445) for resting on an upward facing surface of an element being cut such as a clay slab (105) or other clay element. The guide ruler includes a guiding edge (410) extending along a longitudinal dimension of the guide ruler for defining a cut axis and the cutting guide engages with the guide ruler along the guiding edge and is movable along the guiding edge substantially over the full longitudinal length of the guiding edge.

The cutting is configured to guide a cutting tool such as a pin tool (110) along the cut axis and the cutting tool is further configured to support the cutting tool at a tool angle that causes the cutting tool to cut the element being cut with a beveling angle of greater than 90 degrees with respect to the upward facing surface.

The cutting guide comprising a body (520) formed with a second support surface (525) which is positioned substantially parallel to the first support surface (445) when the cutting guide is engaged with the guiding edge. A plurality of angled through holes (530 extend through the body (520) at a different tool angles and exit from the body through the second support surface (525). Each through hole is configured to guide a pin tool along the cut axis. The pin tool extends below the second support surface to a cut depth. The cut depth may be the full thickness of the element being cut or the pin tool may be supported to provide a cut depth that is less that the full thickness of the element being cut. The pin tool is oriented by an angled through hole. To cut the element being cut at a desired beveling angle (225), the pin tool is installed in a corresponding angled through hole. A non-angled through hole is also provided passing through the cutting guide body for cutting the element being cut with no bevel or with an edge cut perpendicular to the upward facing or finished surface of the clay slab.

The present invention further overcomes the problems cited in the prior art by providing a method for cutting clay elements from a clay slab. In particular, with the clay slab supported on a support surface with a finished surface of the clay slab facing upward, the cutting and beveling tool is disposed on the upward facing surface of the clay slab and the guiding edge (410) is aligned with a desired cut axis. The user may also position the cutting guide off the clay slab to cut start a cut. The user then selects a desired beveling angle in installs the pin tool into an angled through hole associated with the desired beveling angle. If needed the pin tool can be supported at a desired cut depth. The user then advances the cutting guide along the guiding edge to cut and bevel the clay slab along the cut axis.

BRIEF DESCRIPTION OF THE DRAWINGS

The features of the present invention will best be understood from a detailed description of the invention and a preferred embodiment thereof selected for the purposes of illustration and shown in the accompanying drawings in which.

ITEM NUMBERS

| | |
|---|---|
| 100 | cutting and beveling tool |
| 105 | clay slab |
| 110 | pin/needle tool |
| 115 | guide ruler 1st embodiment |
| 120 | cutting guide |
| 125 | angled through holes |
| 130 | clay strip |
| 200 | clay strip |
| 205 | top surface |
| 210 | bottom surface |
| 215 | beveled edge |
| 220 | beveled edge |
| 225 | bevel angle measured from the top surface |
| 300 | cutting and beveling tool |
| 305 | guide ruler |
| 310 | cutting guide |
| 315 | angled through holes |
| 320 | measuring scale |
| 325 | scale center position |
| 400 | 1st cutting guide |
| 405 | 2nd cutting guide |
| 410 | guiding edge |
| 415 | measuring edge |
| 420 | female engaging feature |
| 425 | 1st thickness |
| 430 | 2nd thickness |
| 435 | measuring surface |
| 440 | center wall |
| 445 | support surface |
| 500 | 1st cutting guide |
| 510 | 2nd cutting guide |
| 515 | male engaging feature |
| 520 | body |
| 525 | support surface |
| 530 | angled through holes |
| 535 | non-angled through hole |
| 540 | |
| 545 | 1st molded element |
| 550 | 2nd molded element |
| 700 | clay slab |
| 705 | clay element |
| 710 | beveled edge |
| 800 | clay slab or element |
| 805 | beveled opening |

DESCRIPTION OF THE PREFERRED EMBODIMENTS

Figure 1A:
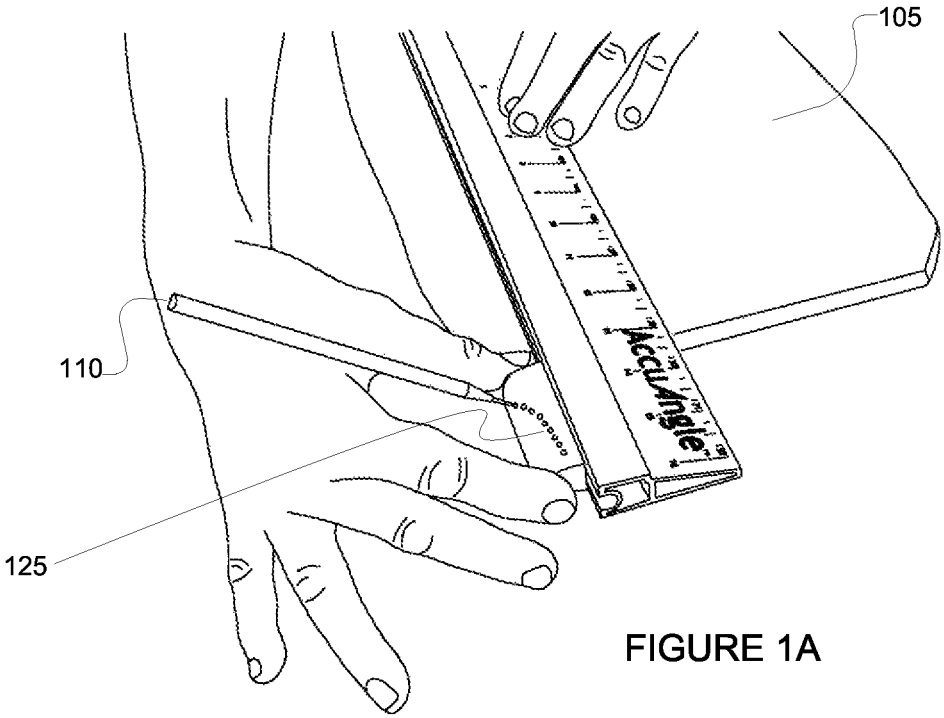
FIG. 1A illustrates an isometric view of a cutting and beveling tool positioned on a clay slab in a start cut position with a pin tool positioned to start a cut according to the present invention.
Figure 1B:
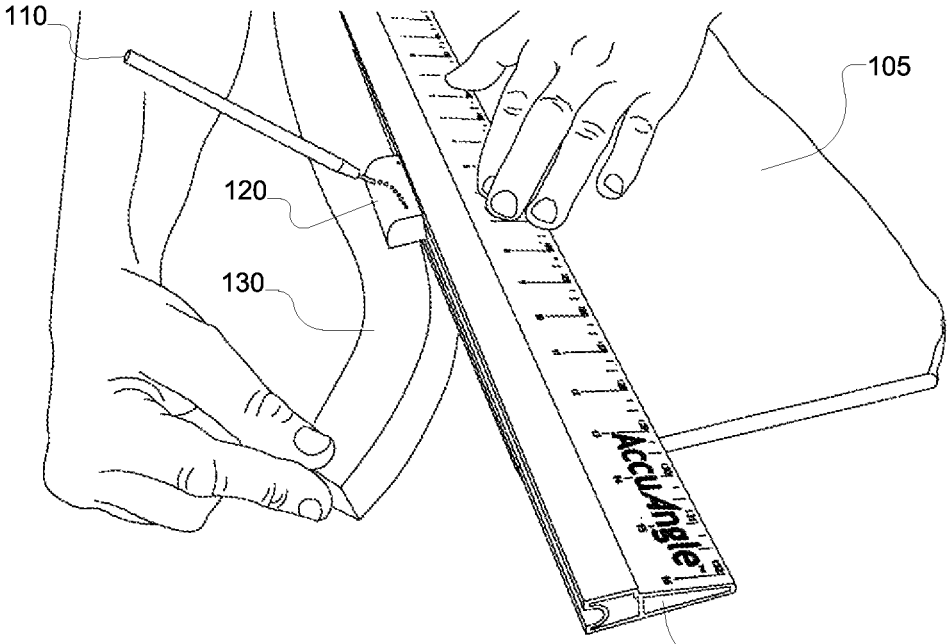
FIG. 1B illustrates an isometric view of a cutting and beveling tool positioned on a clay slab at in a mid-cut position with the pin tool extending through the entire thickness of the clay slab according to the present invention.

Referring to FIGS. 1A and 1B, a cutting and beveling tool (100) according to the present invention is shown in isometric view installed on a clay slab (105). A pin or needle tool (110) is inserted into one of a plurality of angled through holes (125) passing through the cutting and beveling tool (100) and oriented at a desired tool angle by one of the angled through holes (125). The pin tool (110) is a typical clay cutting tool and comprises a cylindrical metal rod attached to a handle. The rod diameter may range from 0.02 to 0.1 inches and may be tapered along its length. The length of the rod extending from the handle typically ranges from 0.75 to 2.5 inches. Preferably the pin tool (110) has a rod that extends 1.25 inches or more from its handle. The pin or needle tool (110) is advanced along a cutting axis to cut the clay slab (105) by advancing the cutting guide (120) along a guiding edge of the guide ruler (115).

Figure 2:
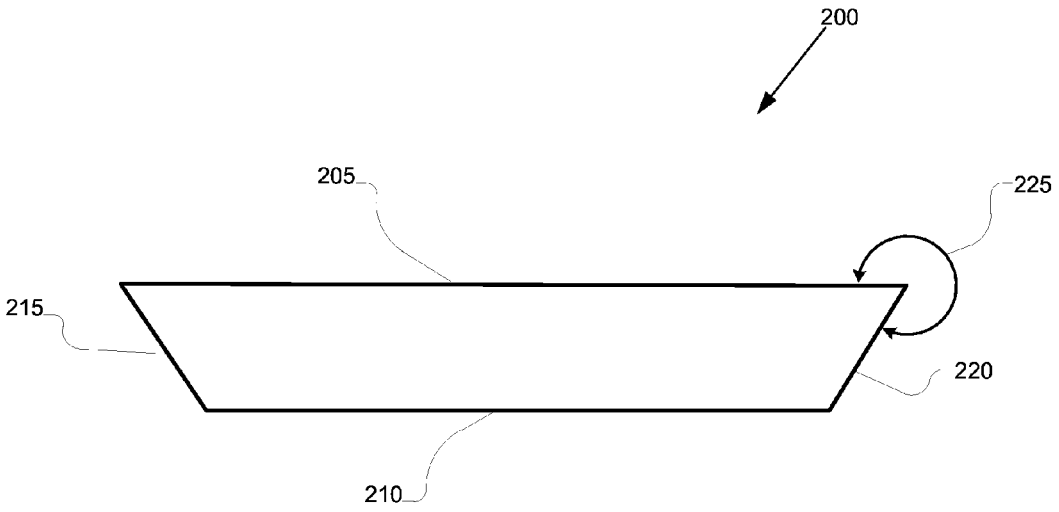
FIG. 2 illustrates a side view of a beveled clay strip cut from a clay slab using the cutting and beveling tool of the present invention.

Referring to FIG. 2, a non-limiting example clay strip (200) cut from the clay slab using the present invention includes a top surface (205), an opposing bottom surface (210) and opposing beveled edges (215) and (220). The beveled edges are examples of beveled edges cut by the cutting and beveling tool (100). In the clay strip example (200) the bevel was cut by the cutting and beveling tool (100) while the cutting and beveling tool (100) was installed on the upward facing surface (205). The beveling angle (225) as measured from the surface (205) is 135 degrees and is cut using a tool angle of 45 degrees which the angle the pin tool makes with respect to support surfaces (445, 525) of the cutting and beveling tool. In the desirable case wherein the top surface (205) is a finished or outside surface and the bottom surface (210) is an unfinished or inside surface, the beveling angle (225) is cut without turning the clay strip over and this allows the user to cut and bevel the clay strip in one step instead of two and to form the beveled edge without turning the clay strip over. The is made possible because the beveling angles (225) cut by the cutting and beveling tool of the present invitation are cut from the upward facing surface at beveling angles (225) that are greater than or equal to 90 degrees as measured from the upward facing surface.

In a typical application a plurality of clay strips like the strip (200) may be cut from the clay slab and joined together to form rectilinear clay elements such as a rectangular or square box that includes four sides joined together at 90 degree angles. The four sides are joined together with the finished or upward facing surface (205) facing outward. Accordingly surfaces (210) are inside surfaces which are beveled at a 45 degree as measured from the inside surfaces (210). In other examples, rectilinear clay elements having 3, 5, 6, 7 or more sides may be fabricated from clay strips cut from the clay slab using the cutting and beveling tool (100). In such cases, a user may choose a beveling angle specifically suited for the number of sides. For example a 5 sided rectilinear container having five equal length sides and five equal angle joints has joint angles of 72 degrees. Accordingly beveling angles of 54 degrees as measured from the bottom surface (210) are desirable and these are formed by the present invention using a beveling angle (225) of 126 degrees which relates to a tool angle of 36 degrees.

Referring to FIGS. 1A, 1B and 2, the clay slab (105) may have various shapes and perimeter dimensions and various thicknesses. In one non-limiting example the clay slab (105) is substantially rectilinear with longitudinal and transverse dimensions ranging from about 0.5 to 36 inches and a thickness dimension ranging from about 0.03 to 0.4 inches. The clay slab (105) may also have a finished surface that is used for forming outside or visible surfaces of clay objects such as cylindrical or rectilinear enclosures formed by clay elements cut from the clay slab. The clay slab may also have an unfinished surface, opposed to the finished surface that is used for forming inside or non-visible surfaces of the clay objects. In some cases, the finished surface may be smoother than the unfinished surface or the finished surface may include decorative features, textures or the like, formed thereon. In one particularly beneficial aspect of the present invention, the cutting and beveling tool (100) is configured to cut while also beveling edges being cut from the finished surface of the clay slab (105) such that the finished surface can be upward facing during cutting steps. More specifically, the cutting and beveling tool (100) is configured to be placed on the finish surface and when used to make a bevel cut, the bevel cut undercuts the finished surface by cutting the bevel greater than 90 degrees as measured from the finished surface. This is shown by the shape of the clay strip shown in FIG. 2 wherein the top surface (205) is a finished surface and the bottom surface (210) is an unfinished surface and each of the beveled edges (215), (220) have a beveling angle of more than 90 degrees as measured form the top finished surface.

Figure 3:
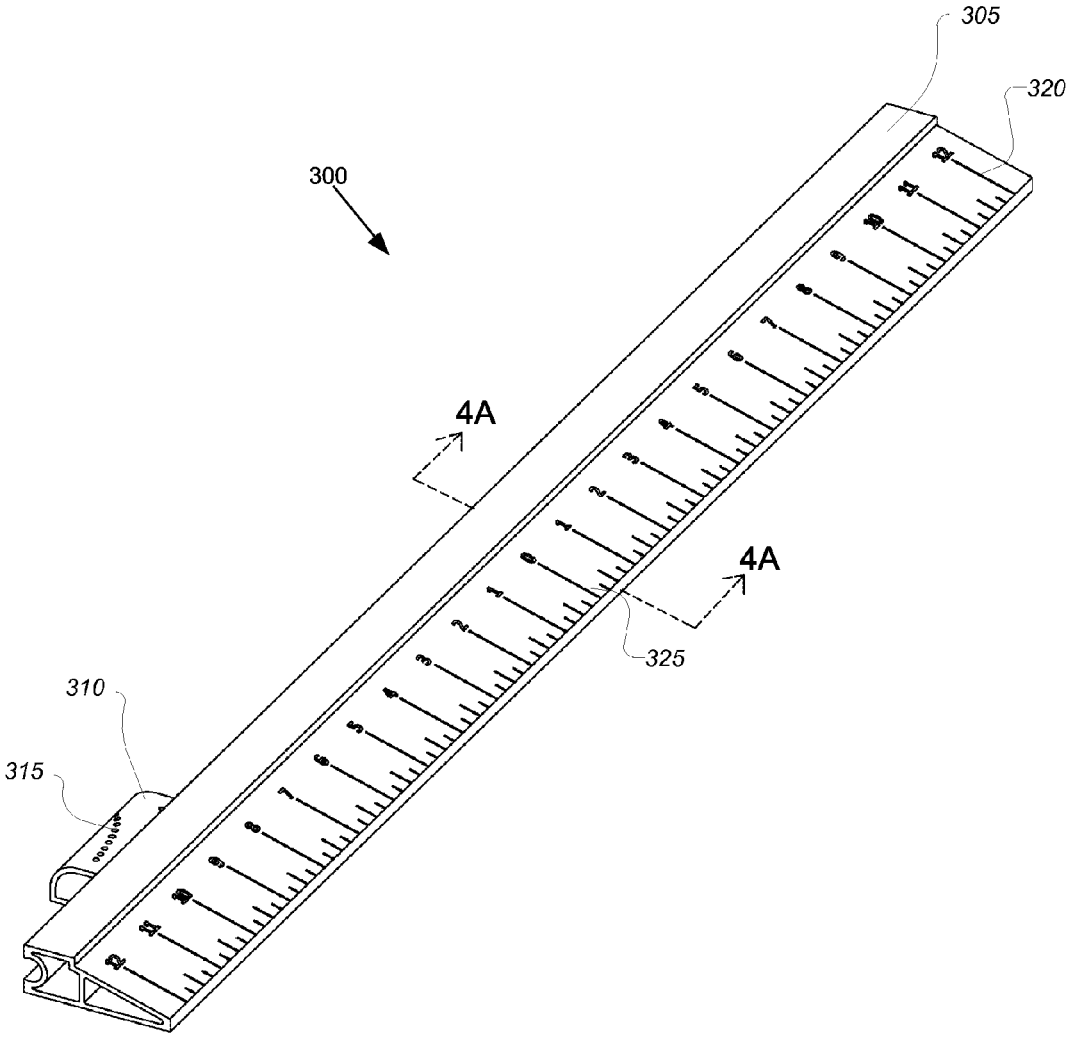
FIG. 3 illustrates an isometric view of a cutting and beveling tool according to the present invention.

Referring now to FIG. 3 a cutting and beveling tool (300) comprises a guide ruler (305) and a cutting guide (310). The cutting guide (310) is movably engaged with the guide ruler (305) for linear movement along a longitudinal axis of the guide ruler (305). The cutting guide (310) is formed with a plurality of angled through holes (315) that pass through a body of the cutting guide. Each through hole (315) is sized to receive the pin tool (110) therein and each through hole (315) is oriented at a different angle with respect to a normal axis of a clay slab when the cutting and beveling tool (300) is placed on the clay slab.

Figure 4A:
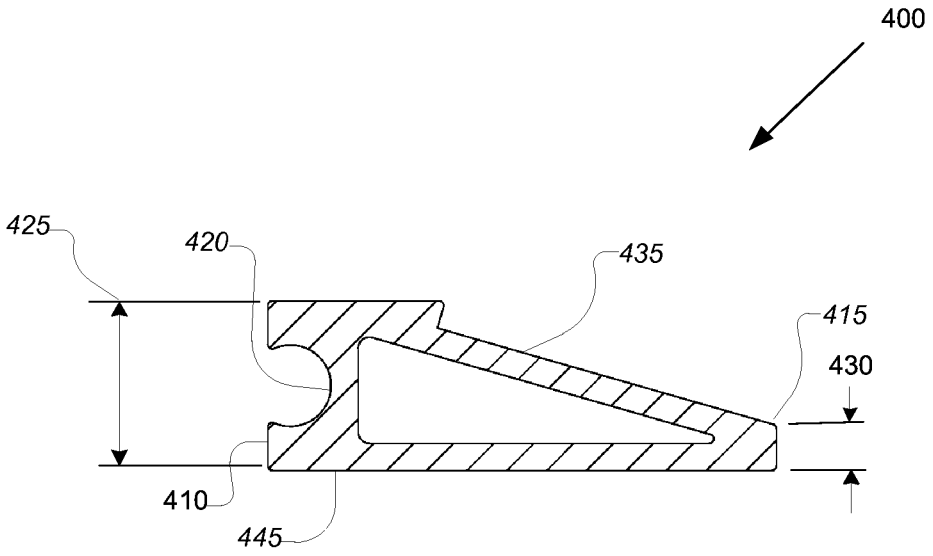
FIG. 4A depicts a section view of a first ruler guide embodiment according to the present invention.
Figure 4B:
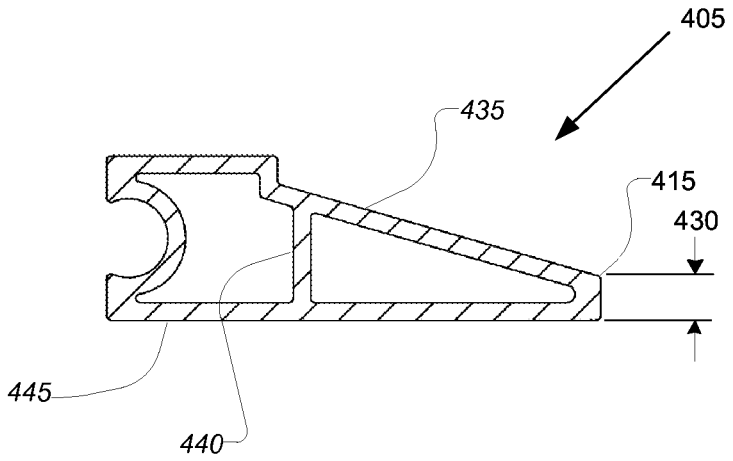
FIG. 4B depicts a section view of a second ruler guide embodiment according to the present invention.

Referring now to FIGS. 3, 4A and 4B, two non-limiting example section views of a guide ruler (305) are shown as (400) and (405) in FIGS. 4A and 4B. The guide ruler (400, 405) comprises opposing longitudinal edges including a guiding edge (410), configured to engage with the cutting guide (310), and a measuring edge (415). The guiding edge (410) includes a female engaging feature (420) such as a half-round slot, or the like, for slidably engaging with the cutting guide (310). Alternately a rolling engagement is usable without deviating from the present invention. The cutting guide (310) engages with the female engaging feature (420) and is slidable along the full longitudinal length of the guiding edge (410). Additionally, as will be described below, the cutting guide (310) is removable from engagement with the female engaging feature (420) for use as a free hand cutting tool.

The guiding edge (410) has a first thickness or height (425) and the guide ruler thickness tapers from the first thickness (425) to a second reduced thickness or height (430) along the measuring edge (135). The first thickness (425) along the guiding edge (410) includes sufficient material for forming the female engaging feature (420). The second thickness (430) is reduced to bring a measurement scale (320) closer to the clay slab for more accurate measuring.

The measuring scale (320) is printed or otherwise formed on a measuring surface (435) substantially along the entire longitudinal length of the guide ruler. The measuring scale (320) allows a user to move the cutting guide (310) along measured distances extending along a longitudinal axis of the guide ruler (305) e.g. for measuring cut lengths, or the measuring scale can be used for other measurements. Preferably the measuring scale includes indicia disposed at ⅛ inch or 1 mm increments along the measuring surface (435). Preferably the measuring scale has a zero point at a center position (325) and increases from zero at the center position to a maximum increment at each end of the measurement surface (435). In one embodiment the guide ruler (305) has a longitudinal length of 16 inches and the measuring scale includes two 8 inch scales extending from the center position (325) to opposing ends of the measuring surface (435). The 16 inch guide ruler is configured to make beveled cuts of approximately up to 15 inches in length. In another embodiment the guide ruler (115) has a longitudinal length of 32 inches and the measuring scale includes two 16 inch scales extending from the center position (325) to opposing ends of the measuring surface (435). The 32 inch guide ruler is configured to make beveled cuts of approximately up to 30 inches in length. Additionally a user may use the measuring scale (320) to make beveled cuts of desired lengths and at desired positions with respect to the center position (325).

In a preferred embodiment the guide ruler (400, 405) comprises a plastic material such as polyvinyl chloride (pvc) or any other plastic material that is suitable for forming by extrusion or similar forming processes. Alternately the guide ruler may comprise aluminum or any other metal that is suitable for forming by extrusion or similar forming processes.

Referring to FIG. 4A the guide ruler (400) comprises a continuous outer wall surrounding a central triangular cavity. The female engaging feature (420) is approximately centered with respect to the first thickness (425) and is formed as a half round slot because the half round slot is suitable for fabrication by extrusion. However other engaging feature shapes are usable including a male engaging feature, without deviating from the present invention. In a preferred embodiment the first thickness (425) is approximately 0.75 inches and the half round slot has a radius of 0.18 inches. Referring to FIG. 4B, the guide ruler (405) includes a continuous outer wall surrounding a central cavity and also includes a vertical center wall (440) for added stiffness.

The ruler guides (400, 405) include a flat support surface (445) that supports the guide ruler on the clay slab during use. Preferably the support surface (445) has a width ranging from 1.0 to 2.5 inches and is formed with a smooth surface finish to prevent deforming the clay slab during use. However other support surface widths are usable without deviating from the present invention. The continuous wall also forms the measurement surface (435) and tapers to the second thickness (430) which is in the present example embodiments is approximately 0.2 inches.

Figure 5A:
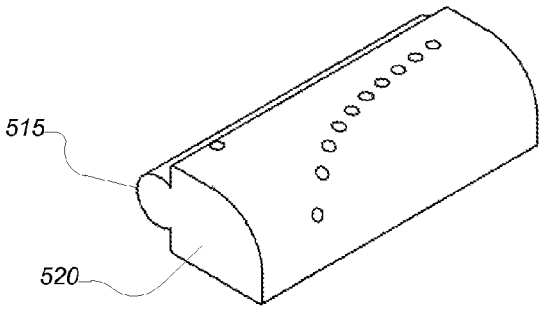
FIG. 5A illustrates an isometric view of a first cutting guide embodiment according to the present invention.
Figure 5B:
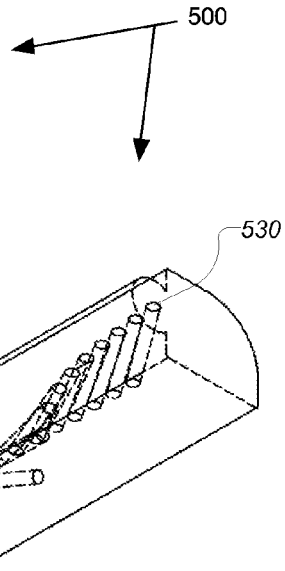
FIG. 5B illustrates a phantom view of the first cutting guide embodiment showing angled and a non-angled through holes according to the present invention.
Figure 6A:
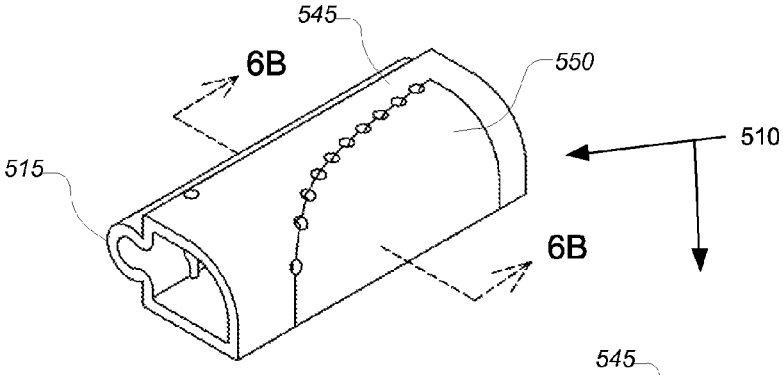
FIG. 6A illustrates an isometric view of a second cutting guide embodiment according to the present invention.
Figure 6B:
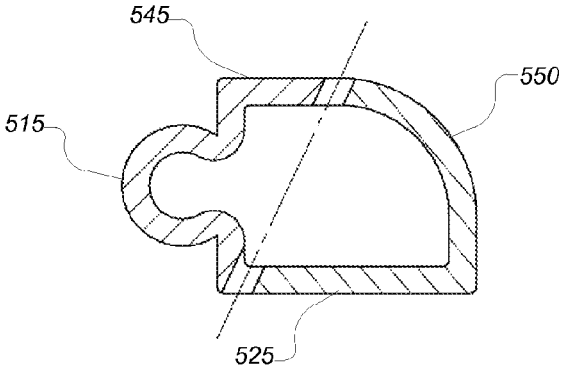
FIG. 6B illustrates a section view of the second cutting guide embodiment according to the present invention

Referring now to FIGS. 3-6B, two non-limiting exemplary cutting guides (500, 510), according to the present invention, are shown in isometric views in FIGS. 5A-6A and in a section view in FIG. 6B. The cutting guides (500, 510) are formed with longitudinal length, transverse width and thickness or height dimensions and include a male engaging feature (515) extending out of a body (520) and along the longitudinal length of the cutting guide. The male engaging feature (515) is sized and shaped to engage with the guide ruler female engaging feature (420). The body (520) of the cutting guides (500, 510) is formed integrally with the male engaging feature (515). When installed on the guide ruler, the body (520) extends laterally from the guiding edge (410) and serves as a user handle for advancing the cutting guide in each direction along the longitudinal dimension of the guide ruler (305). The body (520) includes a support surface (525) that is substantially flush with the guide ruler support surface (445) when the guide ruler and cutting guide are assembled. A plurality of angled through holes (315, 530) extend entirely through the body (520) exiting through the support surface (525). Each angled through hole (530) passes through the body (520) at a different angle (tool angle) with respect to the support surface (525). Each angled through hole (530) is sized to receive the pin/needle tool (110) therein and the pin and needle tool is configured to extend below the support surface (525) while it is supported in an angled through hole. A non-angled through hole (535) is oriented substantially perpendicular to the support surface (525) and is provided for cutting a clay slab with no bevel or with a perpendicular edge. The remaining angled through holes (530) make tool angles of 75, 73.6, 72.0, 70.0, 67.5, 64.2, 60.0, 54.0, 45.0 and 30.0 degrees with respect to the support surface (525). Each angled through hole (535) is oriented to bevel the edge being cut with a beveling angle of greater than 90 degrees as measure from the upward facing surface a clay slab or element being cut. The non-angled through hole (535) makes an angle of 90 degrees with respect to the support surface and the upward facing surface a clay slab or element being cut. The angle of each through hole (530) may be printed or otherwise formed or marked on the body (520). The printed angle may be the tool angle or the beveling angle or both.

As shown in FIGS. 5A and 5B, the cutting guide (500) may comprise a solid element comprising thermoplastic or metal suitable for molding, extruding, casting, machining or other forming methods. When formed as a sold element, the through holes (530, 535) may be installed by separate machining or drilling steps or may be molded in place.

As shown in FIGS. 6A and 6B, the cutting guide (510) may comprise a outer wall surrounding a hollow central cavity with the outer wall comprising thermoplastic or metal suitable for molding, extruding, casting, machining or other forming methods. When formed as unitary element, the through holes (530, 535) may be installed by separate machining or drilling steps or may be molded in place.

In a preferred embodiment, the cutting guide (510) comprise two elements separately injection molded from a thermoplastic material and assembled together by a snap fit or the like. As shown in FIG. 6A, a first element (545) includes the male engaging feature (515), the non-angled through hole (535) and a portion of the body (520) and a second element (550) includes a portion of the body (520). As best viewed in the section view of FIG. 6B, the first element (545) includes a first half of each of the angled holes (530) molded therein and the second element (550) includes a second half of each of the angled holes (530) molded therein. This is further illustrated by the parting line shown in FIG. 6A which passes through each of the angled through holes (530) and represents the parting line between the first element (545) and the second element (550).

Non-limiting example thermoplastics suitable for the cutting guide embodiments (500, 510) include acrylonitrile butadiene styrene (ABS) which provides excellent rigidity and resistant to contamination by various oils and polyoxymethylene (POM) which provides excellent rigidity and hardness as well as a very low coefficient of friction. Additionally either of the example cutting guides (500, 510) may comprise metal suitable for molded, casting, extruding, machining stamping or other metal forming processes.

Referring now to FIGS. 1A, 1B, 4 and 5 a method for using the cutting and beveling tool (100) is illustrated below. Preferably the clay slab (105) is supported on a support surface such as a work table with a finished surface of the clay slab facing upward. The cutting and beveling tool (110) is placed onto the clay slab (105) with at least a portion of its support surface (445) resting on the clay slab (105) and with the tool guiding edge (410) disposed along a desired cutting axis. The cutting guide (120) is positioned at one end of the guide ruler (115). The guide ruler may extend off an edge the clay slab (105) so that the cutting guide (120) is not over the clay slab (105) in a starting position. Alternately, for some cutting operations, the cutting guide (310) is positioned over the clay slab to start a cut.

The pin or needle tool (110) is placed in one of the through holes (125). More specifically a user selects which angled through hole (530) to install the pin tool into according to the desired beveling angle to be formed. Additionally the non-angled through hole (535) can be selected for a perpendicular or non-beveled cut. The pin tool (110) is inserted entirely through the cutting guide body (520) and extended to contact or nearly contact the support surface supporting the clay slab so that the pin tool cuts the entire thickness of the clay slab. The user then grasps the cutting guide by the body (520) with one hand while holding the guide ruler (115) in place with the other hand and advances the cutting guide (120) along the guiding edge (410). The action of advancing the cutting guide (120) advances the pin tool (110) along a cutting axis defined by the guiding edge (410). Since the pin tool extends all the way to the surface that supports the clay slab, the pin tool cuts through the entire thickness of the clay slab (105). If desired, the clay slab (105) may be cut and beveled at a desired beveling angle by selecting an appropriate angled through hole (530) and installing the pin tool therein. Alternately the clay slab (105) may be cut with a perpendicular or 90 degree edge by installing the pin tool in the non-beveled through hole (535).

If a cut is made as long as a longitudinal or transverse dimension of the clay slab, a cut, a clay strip (130) is removed from the clay slab (105). The clay strip (130) may be waste material or in some applications the clay strip (130) may usable to make a clay element. After making a first beveled cut, the user may make a second beveled cut as required to form a clay strip (200) shown in FIG. 2. The second beveled cut is made by turning the tool (100) around and placing it on the clay slab with the guiding edge (410) positioned along a second cutting axis opposed to the first cutting axis. The position of the second cutting axis may be measured using the measuring scale (320) and marked with the pin tool before positioning the guiding edge (410) to make the second beveled cut. Once the guiding edge (410) is in position, the pin tool (110) is installed in the appropriate angled through hole (125) and the cutting guide (120) is advanced to make the second cut. After the second cut is made, a clay strip (200) is removed from the clay slab and may be assembled with other clay strips (200) to form a clay object such as a cylindrical or rectilinear enclosure. As further shown in FIG. 2, the clay strip (200) has a top surface (205) which is the upward facing and finished surface of the clay slab (105), a bottom surface (210) which is an unfinished surface of the clay slab and two beveled edges (215) and (220) which have opposite beveling angles of greater than 90 degrees (225) when measured from the top surface (205).

Figure 7:
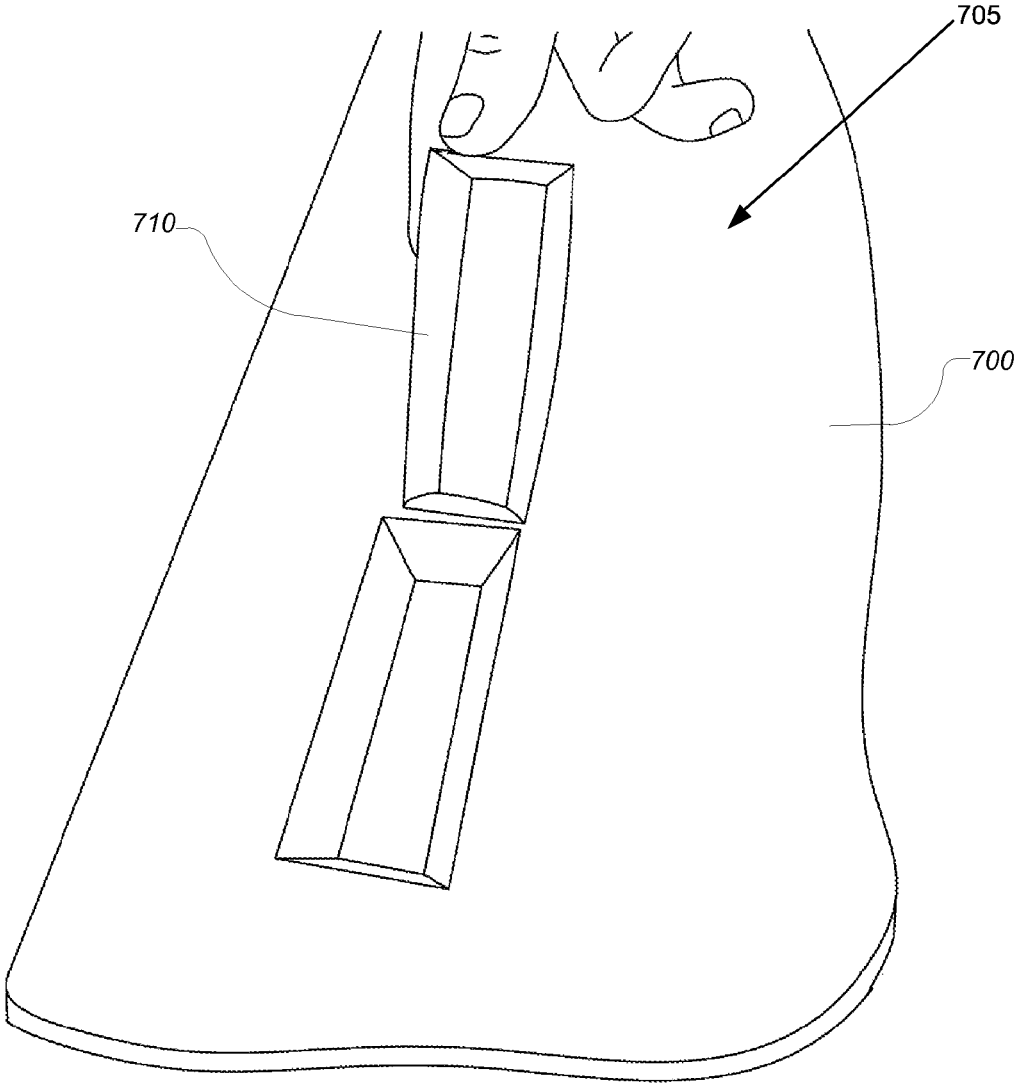
FIG. 7 illustrates an isometric view of a beveled clay element cut from a clay slab and opening formed in the clay slab by removing the beveled clay element using the present invention.

Referring now to FIGS. 3 and 7, a clay element (705) may be cut from a clay slab (700) using the above described cutting and beveling tool (300). In this case the clay element (705) has four beveled edges (710) each having the same beveling angle. To cut the clay element (705) the tool (300) is used to make four beveled cuts. For each beveled cut the user aligns the guiding edge (310) along a desired cutting axis. Once the guiding edge is positioned for a cut, the cutting guide (310) is moved to a cut start position, the pin tool (110) is installed in an appropriate angled through hole (315) and the cutting guide (310) is moved to a cut end position. After four cuts, the clay element (705) is removed from the clay slab. The measuring scale (320) may be used to lay out each cutting axis on the clay slab. The above example also demonstrates how to cut a four-sided beveled opening in a clay element (700).

Figure 8:
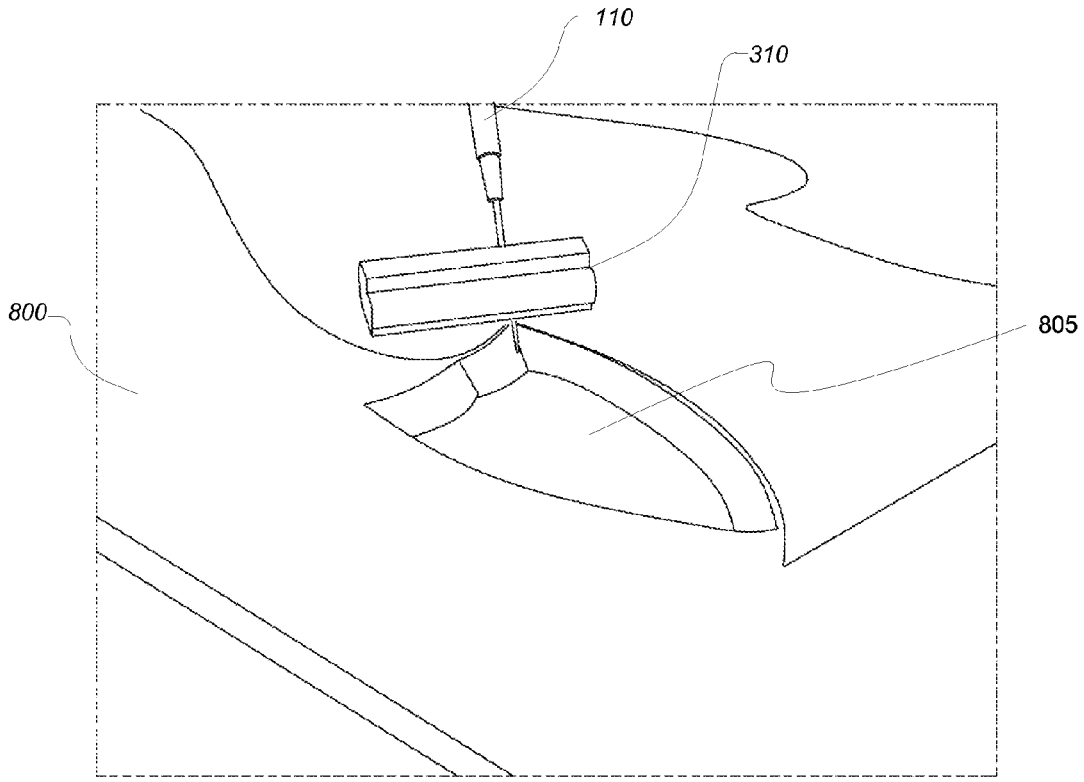
FIG. 8 illustrates an isometric view of a beveled opening cut in a clay slab or element using the cutting guide as a free hand tool according to one aspect of the present invention.

Referring now to FIGS. 3, 5 and 8, the cutting guide (310) may be removed from engagement with the guide ruler (305) and used as a free hand cutting and beveling tool. Accordingly a clay element, not shown, may be cut from a clay slab (800) using the cutting guide (310) and the pin tool (110). In one example use, a beveled opening (805) may be cut in a clay slab, clay strip or clay element. In one advantageous feature or the invention, the opening (805) may be cut from the unfinished surface of a clay slab such that the beveled opening (805) may comprise an interior opening with the beveled edges facing inward. In this case the cutting guide (310) is placed with its support surface (525) in contact with the upward facing surface of the clay slab (800). The cutting guide (310) is then moved to a starting cut position which places a selected angled through hole (315) over a cut start position. The pin tool (110) is then installed into the selected angled through hole (315) and inserted far enough into the angled through hole to contact the clay support surface. Thereafter the user guides the cutting guide over the desired free hand cut while holding the support surface (525) in contact with the upward facing surface of the clay slab.

In a further method according to the present invention, the tool (100) is unable to make beveled cuts that do not extend through the entire clay slab thickness. For example the depth of a cut may be controlled by controlling the length of the pin tool that extends past the cutting guide support surface (525) using a movable depth gage or the like to control the depth of the pin tool with respect to the support surface (525). Thus the tool (100) can be used to make beveled kerf cuts on an unfinished side of a clay strip or slab so that the clay strip or slab may be folded at a specific angle while keeping the finished surface continuous. The tool (100) is usable to cut clay tiles from a clay slab with either a perpendicular edge beveled edge.

It will also be recognized by those skilled in the art that, while the invention has been described above in terms of preferred embodiments, it is not limited thereto. Various features and aspects of the above described invention may be used individually or jointly. Further, although the invention has been described in the context of its implementation in a particular environment, and for particular applications (e.g.), cutting clay strips and other shapes from a clay slab, those skilled in the art will recognize that its usefulness is not limited thereto and that the present invention can be beneficially utilized in any number of environments and implementations where it is desirable to cut beveled edges. Accordingly, the claims set forth below should be construed in view of the full breadth and spirit of the invention as disclosed herein.

The invention claimed is:

1. A cutting and beveling tool (100) comprising:

a guide ruler having a first support surface for resting on an upward facing surface of an element being cut and a guiding edge extending along a longitudinal dimension of the guide ruler for defining a cut axis; and, a cutting guide movably engaged with the guiding edge for moving along the cut axis with respect to the guide ruler and with respect to the element being cut, wherein the cutting guide is configured to guide a cutting tool along the cut axis and to orient the cutting tool for cutting the element being cut with a beveling angle of greater than 90 degrees with respect to the upward facing surface.

2. The clay cutting and beveling tool of claim 1 wherein the cutting guide is configured to orient the cutting tool for cutting the element being cut with a beveling angle of 135 degrees with respect to the upward facing surface.

3. The clay cutting and beveling tool of claim 1 wherein the cutting guide is configured to orient the cutting tool for cutting the element being cut with a beveling angle of one of 120, 135 and 150 degrees with respect to the upward facing surface.

4. The clay cutting and beveling tool of claim 1 wherein the cutting guide is configured to orient the cutting tool for cutting the element being cut with beveling angles ranging from 90 to 165 degrees with respect to the upward facing surface.

5. The clay cutting and beveling tool of claim 1 wherein the cutting tool comprises a pin tool, the cutting guide comprises a body formed with a second support surface positioned substantially parallel to the first support surface and a plurality of angled through holes each extending through the body at a different tool angle and exiting from the body through the second support surface and wherein with each through hole is configured to guide the pin tool along the cut axis with the pin tool oriented at a tool angle that causes the pin tool to cut the element being cut with a beveling angle of greater than 90 degrees with respect to the upward facing surface.

6. The clay cutting and beveling tool of claim 5 further comprising a non-angled through hole extending through the body at a tool angle that is substantially perpendicular to the second support surface wherein the non-angled through hole is configured to guide the pin tool along the cut axis with the pin tool oriented at a tool angle that causes the pin tool to cut the element being cut with a 90 degree angle with respect to the upward facing surface.

7. The clay cutting and beveling tool of claim 6 wherein the plurality of angled through holes includes a through hole oriented at tool angles of 30, 45 and 60 degrees for cutting the element being cut with beveling angles of 120, 135 and 150 degrees with respect to the upward facing surface.

8. The clay cutting and beveling tool of claim 7 wherein the plurality of angled through holes further includes through holes oriented at a tool angles of 54.0, 64.2, 67.5, 70, 72 and 73.6 degrees for cutting the element being cut with beveling angles of 144, 154.2, 157.5, 160, 162 and 136.3 degrees with respect to the upward facing surface.

9. The clay cutting and beveling tool of claim 5 wherein the cutting guide body comprises two different molded elements with portions of each of the one or more through holes formed by two different molded elements.

10. The clay cutting and beveling tool of claim 1 further comprising:

a measuring surface (435) disposed opposed to the support surface and extending substantially along the entire longitudinal length of the guide ruler; and, a measuring scale (320) disposed along the measuring surface for measuring longitudinal motion of the cutting guide as it is moved along the entire longitudinal length of the guide ruler.

11. The clay cutting and beveling tool of claim 1 wherein the first and second engaging features are slidably engaged.

12. The clay cutting and beveling tool of claim 11 wherein the guiding edge forms a first engaging feature and the cutting guide comprises a body formed with a second support surface positioned substantially parallel to the first support surface and further formed with a second engaging feature configured to slidably engage with the first engaging feature.

13. The clay cutting and beveling tool of claim 12 wherein the cutting tool comprises a pin tool further comprising a plurality of angled through holes each extending through the body at a different tool angle and exiting from the body through the second support surface and wherein with each through hole is configured to guide the pin tool along the cut axis with the pin tool oriented at a tool angle that causes the pin tool to cut the element being cut with a beveling angle of greater than 90 degrees with respect to the upward facing surface.

14. The clay cutting and beveling tool of claim 12 wherein the guide ruler comprises extruded thermoplastic material and the cutting guide comprise two molded thermoplastic elements wherein each of the plurality of through holes is formed along a parting line disposed between the two molded thermoplastic elements with each of the molded thermoplastic elements forming a surface of each of the plurality of angled through holes.

15. A method for cutting clay elements from a clay slab comprising:

supporting the clay slab on a support surface with a finished surface of the clay slab facing upward;

disposing a cutting and beveling tool supported on the finished surface and aligning a guiding edge of the cutting and beveling tool along a first desired cut axis wherein the cutting and beveling tool includes a cutting guide slidably engaged with the guiding edge wherein the cutting guide is configured to orient a clay cutting tool at a plurality of different tool angles each oriented to support the cutting tool to move along the cut axis and to cut the clay slab at a beveling angle of greater than 90 degrees with respect to the finished surface;

orienting the cutting tool at a desired beveling angle; and, advancing the cutting guide and the cutting tool supported thereby along the guiding edge thereby cutting and beveling the clay slab along the cut axis at the desired beveling angle in a single step.

16. The method of claim 15 wherein the step of advancing the cutting guide moves the cutting tool across the entire clay slab thereby removing a clay strip from the clay slab.

17. The method of claim 16 further the steps of:

disposing the cutting and beveling tool supported on the finished surface and aligning the guiding edge along a second desired cut axis substantially parallel with, spaced apart from and opposed to the first desired cut axis and wherein the second cut axis is spaced apart from the first cut axis by a desired strip width dimension;

orienting the cutting tool at the same desired beveling angle;

advancing the cutting guide and the cutting tool supported thereby along the guiding edge thereby cutting and beveling the clay slab along the second desired cut axis at the same desired beveling angle and wherein the step of advancing the cutting guide moves the cutting tool across an entire clay slab dimension thereby removing a clay strip from the clay slab.

18. A cutting and beveling tool comprising:

a guide ruler having a first support surface for resting on an upward facing surface of an element being cut, a guiding edge extending along a longitudinal dimension of the guide ruler for defining a cut axis, a female engaging feature formed along the guiding edge, and a measuring surface opposed to the support surface including a measuring scale formed thereon; and, a cutting guide movably engaged with the guiding edge for moving along the cut axis with respect to the guide ruler and the element being cut, comprising a body formed with a second support surface positioned substantially parallel to the first support surface, a male engaging feature extending our from the body for engaging with the female engaging feature and a plurality of angled through holes each extending through the body at a different tool angle and exiting from the body through the second support surface and wherein with each through hole is configured to guide a pin tool along the cut axis with the pin tool oriented at a tool angle that causes the pin tool to cut the element being cut with a beveling angle of greater than 90 degrees with respect to the upward facing surface.

19. The cutting and beveling tool of claim 18 wherein the guide ruler comprises extruded thermoplastic material.

20. The cutting and beveling tool of claim 18 wherein the cutting guide comprise two molded thermoplastic elements wherein each of the plurality of through holes is formed along a parting line disposed between the two molded thermoplastic elements with each of the molded thermoplastic elements forming a surface of each of the plurality of angled through holes.

* * * * *